United States Patent [19]

Pownall

[11] Patent Number: 4,530,262

[45] Date of Patent: Jul. 23, 1985

[54] RELEASABLY LOCKABLE ARTICULATED HANDLE

[76] Inventor: Larry D. Pownall, 3731 E. Altadena Ave., Phoenix, Ariz. 85028

[21] Appl. No.: 501,063

[22] Filed: May 31, 1983

[51] Int. Cl.[3] ..... B25G 1/12

[52] U.S. Cl. ..... 81/177.9; 81/177.1; 403/92

[58] Field of Search ..... 81/177 ST, 177.8, 177.9; 403/92

[56] References Cited

U.S. PATENT DOCUMENTS

| | | | |
|---|---|---|---|
| 1,080,121 | 12/1913 | Oriol | 81/177.8 |
| 2,556,995 | 6/1951 | Coffing | 81/177.9 UX |
| 2,921,773 | 1/1960 | Hoelzer | 81/177.8 X |
| 3,349,650 | 10/1967 | Wright | 81/177 ST X |
| 3,419,295 | 12/1968 | Small | 403/92 |

FOREIGN PATENT DOCUMENTS

| | | | |
|---|---|---|---|
| 402843 | 9/1924 | Fed. Rep. of Germany | 81/177.8 |
| 583335 | 10/1924 | France | 81/177 ST |

*Primary Examiner*—James G. Smith
*Attorney, Agent, or Firm*—Harvey B. Jacobson

[57] ABSTRACT

A pair of elongated arm members are provided disposed in generally the same plane and including one pair of overlapped ends pivotally interconnected for relative swinging of the arm members about an axis generally normal to the aforementioned plane. Lock structure is shiftably supported relative to the overlapped ends of the arm members and is movable between a first active position locking the arm members in adjusted angularly displaced positions relative to each other and a second inactive position allowing at least substantially free relative angular displacement of the arm members. The ends of the arm members remote from the overlapped ends thereof include non-circular recesses formed therein for receiving nuts or bolt heads therein against rotation of the nuts or bolt heads relative to the arm members and the lock structure is shiftably supported from one of the overlapped ends of the arm members for limited displacement along the axis of relative oscillation of the arm members.

2 Claims, 3 Drawing Figures

RELEASABLY LOCKABLE ARTICULATED HANDLE

BACKGROUND OF THE INVENTION

Various forms of wrenches heretofore have been provided for special purpose or situation use. A typical form of special situation or use wrench comprises a double end box wrench having an arcuate handle. Such a wrench is designed to faciliate removal of starters from certain types of automotive engines.

Although various forms of special use wrenches have been designed including angulated and arcuate handles, most of these tools may be used in only one special situation. Accordingly, a need exists for a multi-situation special use tool which may be adjusted to allow its use in different special situations.

Examples of various forms of special use tools including some of the general structural and operational features of the instant invention are disclosed in U.S. Pat. Nos. 1,175,973, 1,302,179, 1,369,829, 1,503,084 and 1,747,527.

BRIEF DESCRIPTION OF THE INVENTION

The tool of the instant invention includes an articulated handle having opposite end portions which may be adjustably angularly displaced relative to each other and the free ends of the opposite end portions are provided with recesses in which nuts or bolt heads may be engaged. The opposite end portions of the handle are pivotally connected in overlapped relation for relative angular displacement about an axis disposed substantially normal to a plane in which the end portions are swingable and lock structure is operatively connected between the end portions of the handle whereby the end portions may be selectively locked in adjusted position against relative angular displacement with the end portions of the handle being disposed in predetermined relatively angulated positions. By this type of construction the handle or wrench may be adjusted as desired to provide the necessary clearance about a stationary part of a piece of machinery being worked upon by a person gripping one end of the wrench and having the other end thereof engaged with a nut or bolt head.

The main object of this invention is to provide an elongated wrench including an articulated handle portion.

Another object of this invention is to provide an elongated wrench in accordance with the preceding object and equipped with lock structure whereby the opposite end portions of the handle of the wrench may be locked in adjusted predetermined relatively angularly displaced position.

Still another object of this invention is to provide an elongated handle construction of the articulated type and whereby opposite end portions of the handle may be adjustably angularly displaced relative to each other.

Still another object of this invention is to provide a releasably lockable articulated handle wherein the lock structure for retaining the opposite end portions of the handle in predetermined adjusted angular position may be released and applied, when desired, with little effort.

A final object of this invention to be specifically enumerated herein is to provide a releasably lockable articulated handle in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
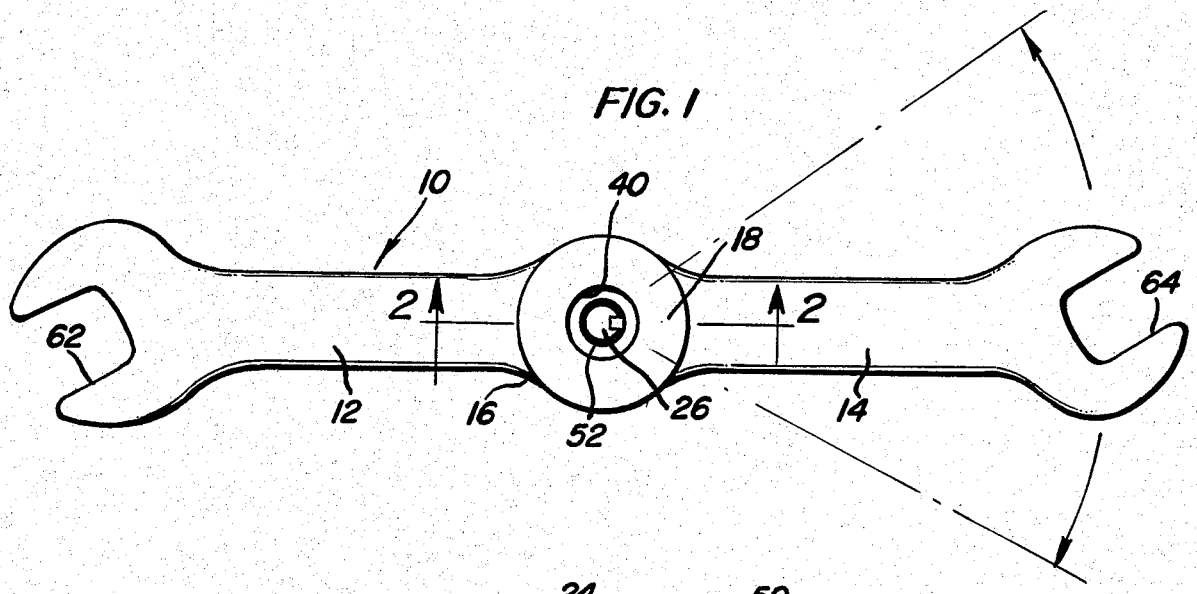
FIG. 1 is a plane view of the releasably lockable articulated handle of the instant invention.

Referring now more specifically to the drawings the numeral 10 generally designates the articulated handle assembly of the instant invention. The handle assembly 10 includes a pair of elongated arm members 12 and 14 including one pair of overlapped end portions 16 and 18. The end portion 16 defines a laterally outwardly opening abbreviated recess 20 closed at its inner end by a circular end wall 22 and a square cross-sectional support shank 24 is centrally supported on the end wall 22 and projects outwardly of the recess 20. The outer end portion 26 of the shank 24 is circular in cross-sectional shape and slightly reduced in transverse dimension relative to the remainder of the shank 24 and one side of the shank 24 includes a central laterally outwardly opening groove 28 formed therein which also opens outwardly of the outer end portion 26. The groove 26 is registered with a square opening 30 formed in the end wall 22 and the outer end portion 26 is provided with a circumferentially extending groove 32.

The end portion 18 defines a laterally outwardly opening recess 34 closed by an inner circular end wall 36 and the end wall 36 has a central bore or opening 38 formed therethrough equipped with an outer end counterbore 40. The inner extremity of the recess 34 has peripherally spaced teeth 42 formed therein and the outer portion of the recess 34 is cylindrically smooth as at 44 and is of a diameter slightly greater than the maximum diameter of the inner toothed portion of the recess 34.

A gear wheel 46 is provided with a central square opening 48 formed therethrough and the gear wheel 46 is telescoped downwardly over the shank 24. The gear wheel 46 includes a square cross-sectional thrust bar 50 extending through the opening 48 and secured, centrally, to one side of the opening 48. The thrust bar 50 is slidably received within the groove 28 with one end of the bar slidably receivable through the opening 30 and the other end of the bar slidable through the opening 38. The end portion 18 is telescoped into the recess 20 with the gear wheel 46 received in the recess 34 and the shank 24 projecting through the opening 38. A retainer washer 52 is removably engaged in the groove 32 and seats against the inner end of the counterbore 40 to retain the shank 24 in the position thereof illustrated in FIG. 2 of the drawings with the end portion 26 projecting through the opening 38.

The longitudinal mid-portion of the thrust bar 50 is provided with a recess 54 on the side thereof remote from the side of the opening 48 against which the thrust bar 50 is anchored and the shank 24 includes a recess 56 formed therein opening into and outwardly of the groove 28. A ball detent 58 backed by a compression spring 60 seated in the recess 56 is disposed in the outer end of the recess 56 and is seatable in the recess 54 when the gear wheel 46 is in the uppermost position thereof illustrated in FIG. 2, the gear wheel 46 being meshed with the teeth 42 and thus locking the arm members 12 and 14 in adjusted angularly displaced positions.

Figure 2:
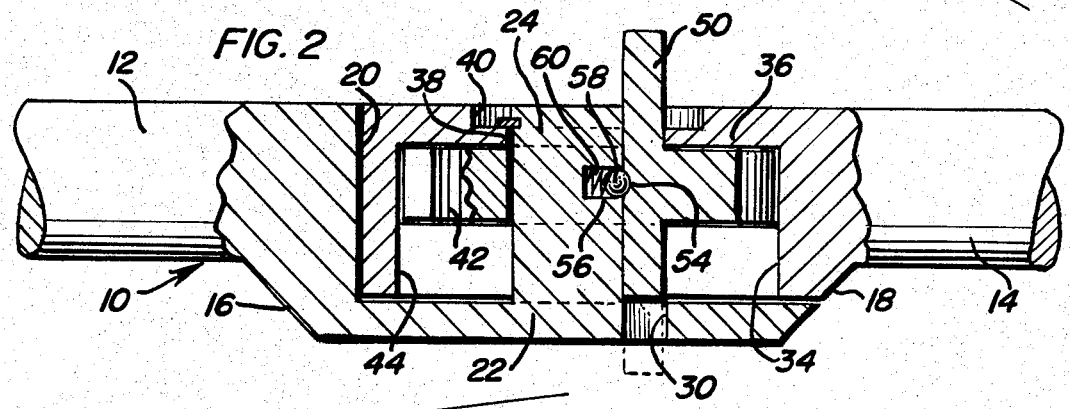
FIG. 2 is an enlarged fragmentary vertical sectional view taken substantially upon the plane indicated by the section line 2—2 of FIG. 1.
Figure 3:
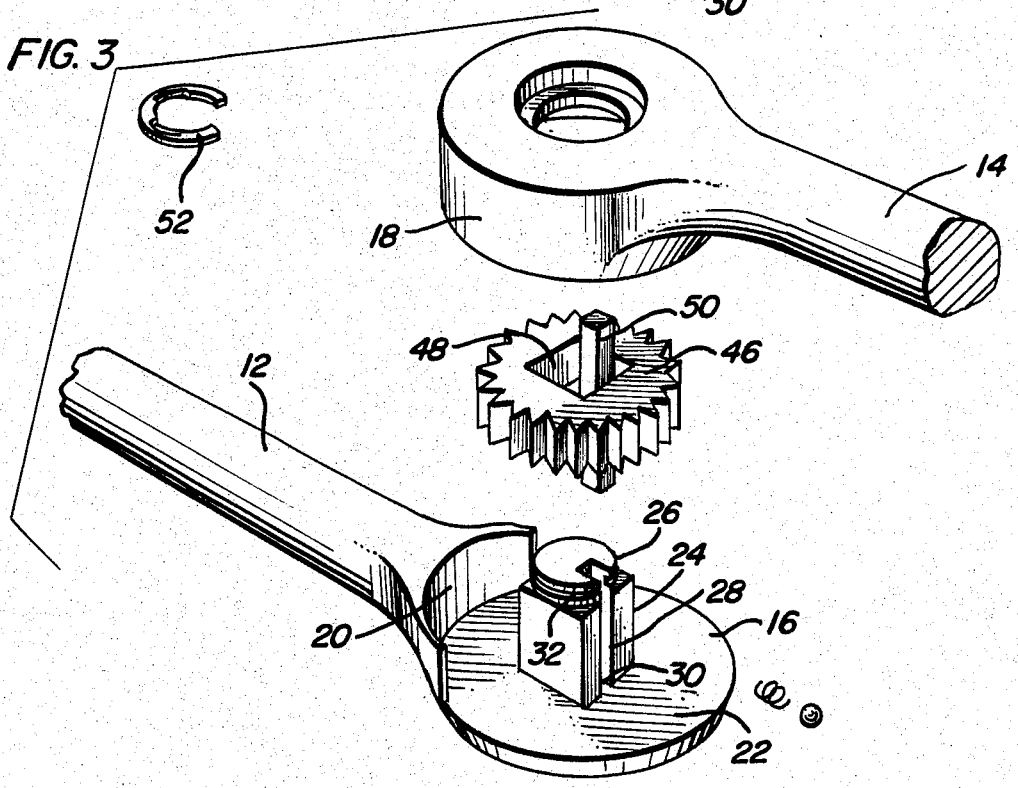
FIG. 3 is a fragmentary exploded perspective view of the relatively pivotable overlapping ends of the articulated handle.

When it is desired to adjust the relative angular displacement of the arm members 12 and 14, the end of the thrust bar 50 projecting from the counterbore 40 is displaced inwardly of the counterbore 40 in order to axially shift the gear wheel 46 from the toothed portion of the recess 34 and into the cylindrical portion 44 of the recess 34. The, the arm members 12 and 14 are relatively angularly displaced as desired and the remote end of the thrust bar 50 may be displaced inwardly of the opening 30 to again axially shift the gear wheel 46 back into meshed engagement with the teeth 42 as shown in FIG. 2 of the drawings. In this position, the detent 58 retains the gear wheel 46 in meshed engagement with the teeth 42.

The ends of the arm members 12 and 14 remote from the end portions 16 and 18 are equipped with endwise outwardly opening notches or recesses 62 and 64 in which nuts or bolt heads may be engaged. The sizes of the recesses 62 and 64 may be as desired. Further, the free ends of the arm members 12 and 14 could comprise box wrench end portions or even adjustable wrench head portions. In addition, it is to be noted that the handle assembly 10 may be used in different environments and that the free ends of the arm members 12 and 14 may be provided with any suitable structures in lieu of the recesses or notches 62 and 64.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A releasably lockable articulated handle assembly including a pair of elongated arm members disposed in generally the same plane and including one pair of overlapped ends pivotally interconnected for relative swinging movement of said arm members about an axis generally normal to said plane, lock means shiftably supported relative to said arm members and movable between a first active position locking said arm members in angularly displaced positions relative to each other and a second inactive position allowing at least substantially free relative angular displacement of said arm members, one of said overlapped ends defining a first laterally outwardly opening recess and a non-circular shank portion projecting outwardly of the central portion of the inner end of said recess, said shank portion being at least generally coaxial with said axis, the other of said overlapped ends defining a head thereon received in said recess and defining a second laterally opening recess opening axially into said first recess, said lock means including a toothed gear axially slidable on said shank portion and non-rotatable relative thereto, said second recess including peripherally spaced teeth with which said toothed gear may be meshed, said peripherally spaced teeth being confined to an inner portion of said second recess, said gear being disposed within the inner portion of said second recess and meshed with said teeth when in said active position and being disposed in an outer portion of said second recess out of meshed engagement with said teeth when in said inactive position, said arm members including end wall portions defining the inner limits of said recesses, said end wall portion of said other overlapped end having an opening formed therethrough rotatably receiving the free end of said shank portion therethrough and including an outer end counterbore, a retaining member releasably engaged with said free end of said shank portion and seated in said counterbore, said shank portion being polygonal in cross section and having a longitudinal groove formed in one side surface thereof opening endwise outwardly of the shank portion end remote from said one overlapped end wall portion, the last mentioned end wall portion having a small opening formed therein registered with the adjacent end of said groove, said toothed gear including a central polygonal opening formed therethrough of a size and shape corresponding to the cross-sectional size and shape of said shank portion, one of the sides of said opening corresponding to said one side surface of said shank portion including an elongated thrust bar fixed thereon extending longitudinally through said central opening and outward beyond the axial end faces of said toothed gear, the end of said bar corresponding to said last mentioned end wall portion being longitudinally shiftable through said small opening and the other end of said bar being longitudinally extendable and retractable relative to the end of said groove which opens through the end of said shank portion remote from said one overlapped end wall portion, said gear and shank portion including coacting means yieldingly retaining said gear in said active position.

2. The handle assembly of claim 1 wherein the other pair of ends of said arm members include non-circular recesses formed therein for receiving nuts or bolt heads therein against rotation of said nuts or bolt heads relative to said arm members.

* * * * *